US006847293B2

(12) United States Patent
Menard et al.

(10) Patent No.: US 6,847,293 B2
(45) Date of Patent: Jan. 25, 2005

(54) DETECTION SYSTEM USING PERSONAL COMMUNICATION DEVICE WITH RESPONSE

(75) Inventors: Raymond J. Menard, Hastings, MN (US); Curtis E. Quady, Burnsville, MN (US)

(73) Assignee: Royal Thoughts, LLC, Minneapolis, MN (US)

( * ) Notice: Subject to any disclaimer, the term of this patent is extended or adjusted under 35 U.S.C. 154(b) by 0 days.

(21) Appl. No.: 10/322,374

(22) Filed: Dec. 17, 2002

(65) Prior Publication Data

US 2003/0156028 A1 Aug. 21, 2003

Related U.S. Application Data

(63) Continuation of application No. 09/219,737, filed on Dec. 22, 1998.

(60) Provisional application No. 60/098,270, filed on Aug. 28, 1998.

(51) Int. Cl.[7] ..... G08B 1/08

(52) U.S. Cl. ..... 340/539.1; 340/539.11; 340/539.13; 340/539.18; 340/825.36; 340/825.49

(58) Field of Search ..... 340/539.1, 539.11, 340/539.13, 539.16, 539.17, 539.18, 825.36, 825.49

(56) References Cited

U.S. PATENT DOCUMENTS

| | | | | |
|---|---|---|---|---|
| 3,843,841 | A | 10/1974 | Rubenstein | 179/5 P |
| 3,969,709 | A | 7/1976 | Isaacs et al. | 340/224 |
| 4,237,344 | A | 12/1980 | Moore | 179/2 A |
| 4,284,849 | A | 8/1981 | Anderson et al. | 179/5 R |
| 4,303,801 | A | 12/1981 | Anderson et al. | 179/5 R |
| 4,531,527 | A | 7/1985 | Reinhold, Jr. et al. | 128/696 |
| 4,772,876 | A | 9/1988 | Laud | 340/539 |
| 4,789,859 | A | 12/1988 | Clarkson et al. | 340/825.31 |
| 4,843,377 | A | 6/1989 | Fuller et al. | 340/573 |
| 4,856,047 | A | 8/1989 | Saunders | 379/57 |
| 4,908,600 | A | 3/1990 | Martinez | 340/310 R |
| 4,993,059 | A | 2/1991 | Smith et al. | 379/39 |
| 4,994,787 | A | 2/1991 | Kratt et al. | 340/505 |
| 5,016,172 | A | 5/1991 | Dessertine | 364/413.02 |
| 5,025,374 | A | 6/1991 | Roizen et al. | 364/413.02 |
| 5,062,147 | A | 10/1991 | Pickett et al. | 364/900 |
| 5,081,667 | A | 1/1992 | Drori et al. | 379/59 |
| 5,128,979 | A | 7/1992 | Reich et al. | 379/40 |
| 5,179,571 | A | 1/1993 | Schilling | 375/1 |
| 5,195,126 | A | 3/1993 | Carrier et al. | 379/45 |
| 5,223,844 | A | 6/1993 | Mansell et al. | 342/357 |
| 5,228,449 | A | 7/1993 | Christ et al. | 128/691 |
| 5,276,728 | A | 1/1994 | Pagllaroli et al. | 379/58 |
| 5,278,539 | A | 1/1994 | Lauterbach et al. | 340/539 |

(List continued on next page.)

OTHER PUBLICATIONS

*Skyroute Communications*, http://www.sur–gard.com/skyroute.htm,(1974),pp. 1–4.

"21st Century Emergency Safety Communication Policy", *comCARE Alliance*, http://www.comcare.org/21ct99.htm, (2000),pp. 1–3.

"AlarmNet–A Original Alarmnet", *AlarmNet*, http;//www.ademco.com/AlarmNet/AlarmNetA.htm,(2000),pp. 1–2.

"AlarmNet–C Control Channel Cellular", *AlarmNet*, http://www.ademco.com/AlarmNet/AlarmNetC.htm,(2000),2 pages.

(List continued on next page.)

*Primary Examiner*—Daryl Pope
(74) *Attorney, Agent, or Firm*—Schwegman, Lundberg, Woessner & Kluth, P.A.

(57) ABSTRACT

This system provides for apparatus and process in conjunction with long-range wireless communication networks such as paging, cell phone and other networks. The system provides for alarm and other signals received from a security or other type of detection system to be verified by a remote user so as to assist in the cancellation of alarms so that false dispatches can be prevented.

19 Claims, 3 Drawing Sheets

U.S. PATENT DOCUMENTS

| | | | | |
|---|---|---|---|---|
| 5,319,355 | A | 6/1994 | Russek | 340/573 |
| 5,319,698 | A | 6/1994 | Glldewell et al. | 379/39 |
| 5,333,173 | A | 7/1994 | Seazholtz et al. | 379/45 |
| 5,351,235 | A | 9/1994 | Lahtinen | 370/58.1 |
| 5,390,238 | A | 2/1995 | Kirk et al. | 379/93 |
| 5,398,782 | A | 3/1995 | Talbot et al. | 187/393 |
| 5,400,246 | A | 3/1995 | Wilson et al. | 364/146 |
| 5,402,466 | A | 3/1995 | Delahanty | 379/44 |
| 5,404,577 | A | 4/1995 | Zuckerman et al. | 455/66 |
| 5,410,292 | A | 4/1995 | Le Van Suu | 340/310.06 |
| 5,412,372 | A | 5/1995 | Parkhurst et al. | 340/568 |
| 5,416,695 | A | 5/1995 | Stutman et al. | 364/413.02 |
| 5,432,841 | A | 7/1995 | Rimer | 379/59 |
| 5,451,839 | A | 9/1995 | Rappaport et al. | 375/224 |
| 5,485,504 | A | 1/1996 | Ohnsorge | 379/58 |
| 5,486,812 | A | 1/1996 | Todd | 340/539 |
| 5,487,108 | A | 1/1996 | Atkins et al. | 379/355.06 |
| 5,507,162 | A | 4/1996 | Chhatwal | 70/276 |
| 5,513,111 | A | 4/1996 | Wortham | 364/460 |
| 5,552,641 | A | 9/1996 | Fischer et al. | 307/10.5 |
| 5,568,535 | A | 10/1996 | Sheffer et al. | 379/39 |
| 5,570,083 | A | 10/1996 | Johnson | 340/692 |
| 5,583,517 | A | 12/1996 | Yokev et al. | 342/457 |
| 5,583,831 | A | 12/1996 | Churchill et al. | 368/10 |
| 5,587,701 | A | 12/1996 | Hess | 340/541 |
| 5,630,207 | A | 5/1997 | Gitlin et al. | 455/54.1 |
| 5,640,147 | A | 6/1997 | Chek et al. | 340/573 |
| 5,652,564 | A | 7/1997 | Winbush | 340/426 |
| 5,687,215 | A | 11/1997 | Timm et al. | 379/58 |
| 5,712,619 | A | 1/1998 | Simkin | 340/539 |
| 5,719,551 | A | 2/1998 | Flick | 340/426 |
| 5,736,932 | A | 4/1998 | Bulfer et al. | 340/825.34 |
| 5,739,748 | A | 4/1998 | Flick | 340/426 |
| 5,742,233 | A | 4/1998 | Hoffman et al. | 340/573 |
| 5,752,976 | A | 5/1998 | Duffin et al. | 607/32 |
| 5,754,111 | A | 5/1998 | Garcia | 340/573 |
| 5,777,551 | A | 7/1998 | Hess | 340/541 |
| 5,784,685 | A | 7/1998 | Stanford et al. | 455/31.2 |
| 5,786,746 | A | 7/1998 | Lombardo et al. | 340/286.07 |
| 5,793,283 | A | 8/1998 | Davis | 340/426 |
| 5,812,536 | A | 9/1998 | Manduely | 370/262 |
| 5,815,417 | A | 9/1998 | Orr et al. | 364/578 |
| 5,821,854 | A | 10/1998 | Dorinski et al. | 340/539 |
| 5,825,283 | A | 10/1998 | Camhi | 340/438 |
| 5,845,203 | A | 12/1998 | LaDue | 455/414 |
| 5,850,180 | A | 12/1998 | Hess | 340/541 |
| 5,850,344 | A | 12/1998 | Conkright | 364/479.01 |
| 5,852,408 | A | 12/1998 | Christiansen et al. | 340/870.09 |
| H1782 | H | 2/1999 | Wicks et al. | 340/825.44 |
| 5,870,020 | A | 2/1999 | Harrison, Jr. | 340/426 |
| 5,873,043 | A | 2/1999 | Comer | 455/458 |
| 5,874,889 | A | 2/1999 | Higdon et al. | 340/426 |
| 5,892,442 | A | 4/1999 | Ozery | 340/539 |
| 5,894,591 | A | 4/1999 | Tamayo | 455/31.2 |
| 5,898,391 | A | 4/1999 | Jefferies et al. | 340/988 |
| 5,898,904 | A | 4/1999 | Wang | 455/31.3 |
| 5,902,234 | A | 5/1999 | Webb | 600/300 |
| 5,907,279 | A | 5/1999 | Bruins et al. | 340/506 |
| 5,917,405 | A | 6/1999 | Joao | 340/426 |
| 5,933,080 | A | 8/1999 | Nojima | 340/539 |
| 5,940,007 | A | 8/1999 | Brinkmeyer et al. | 340/825.69 |
| 5,959,529 | A | 9/1999 | Kail, IV | 340/539 |
| 5,983,347 | A | 11/1999 | Brinkmeyer et al. | 713/200 |
| 6,023,223 | A | 2/2000 | Baxter, Jr. | 340/531 |
| 6,023,241 | A | 2/2000 | Clapper | 342/357.13 |
| 6,023,620 | A | 2/2000 | Hansson | 455/419 |
| 6,028,514 | A | 2/2000 | Lemelson et al. | 340/539 |
| 6,035,021 | A | 3/2000 | Katz | 379/93.12 |
| 6,035,217 | A | 3/2000 | Kravitz | 455/561 |
| 6,038,896 | A | 3/2000 | Chamberlain et al. | 70/279.1 |
| 6,044,257 | A | 3/2000 | Boling et al. | 455/404 |
| 6,057,758 | A | 5/2000 | Dempsey et al. | 340/539 |
| 6,072,402 | A | 6/2000 | Kniffin et al. | 340/825.31 |
| 6,084,510 | A * | 7/2000 | Lemelson et al. | 340/539.13 |
| 6,085,079 | A | 7/2000 | Tabeta | 455/403 |
| 6,087,952 | A | 7/2000 | Prabhakaran | 340/693.5 |
| 6,089,058 | A | 7/2000 | Elpern et al. | 70/279.1 |
| 6,118,866 | A | 9/2000 | Shtivelman | 379/309 |
| 6,147,622 | A | 11/2000 | Fonea | 340/825.31 |
| 6,148,213 | A | 11/2000 | Bertocci et al. | 455/462 |
| 6,160,877 | A | 12/2000 | Tatchell et al. | 379/197 |
| 6,192,248 | B1 | 2/2001 | Solondz | 455/450 |
| 6,288,641 | B1 | 9/2001 | Casais | 340/539 |
| 6,295,346 | B1 | 9/2001 | Markowitz et al. | 379/127.01 |
| 6,340,928 | B1 | 1/2002 | McCurdy | 340/436 |
| 6,356,192 | B1 | 3/2002 | Menard et al. | 340/359 |
| 6,388,612 | B1 | 5/2002 | Neher | 342/357.07 |
| 6,442,241 | B1 | 8/2002 | Tsumpes | 379/45 |
| 6,529,723 | B1 | 3/2003 | Bentley | 455/405 |
| 6,542,733 | B1 | 4/2003 | Dennis | 455/433 |
| 6,563,910 | B2 | 5/2003 | Menard et al. | 379/45 |
| 6,567,671 | B2 | 5/2003 | Amin | 455/415 |
| 6,591,094 | B1 | 7/2003 | Bentley | 455/405 |
| 6,608,557 | B1 | 8/2003 | Menard et al. | 340/506 |
| 6,667,688 | B1 | 12/2003 | Menard et al. | 340/531 |
| 6,671,351 | B2 | 12/2003 | Menard et al. | 379/45 |
| 2002/0009184 | A1 | 1/2002 | Shnier | 379/142.01 |
| 2002/0075940 | A1 | 6/2002 | Haartsen | 375/132 |

OTHER PUBLICATIONS

"AlarmNet–M Mobitex System", *AlarmNet*, http://www.a-demco.com/AlarmNet/AlarmNetM.htm,(2000),p.1.

"allNetDevices:—Geoworks, Openware End Patent Fight", *allNetDevices*, http://www.devices.internet.com,(2000),1 page.

"allNetDevices:—The Device–Centric Home in 2000: Close, But No Cigar", *allNetDevices*, http://www.devices.Internet.com,(2000),3 pages.

"ARM7 Thumb Family", *Arm Powered*, Product Information,(Prior to May 26, 2000),4 pgs.

"ARM9 Thumb Family", *Arm Ltd.*, Product Information, (Prior to May 26, 2000),6 pgs.

"Automatic Crash Notification", *ComCare Alliance*, http://www.comcare.org/overview.htm,(2000),2 pages.

"Blue–Connect", *Acer NeWeb Corporation*, Product Brief, (Prior to May 26, 2000),1 pg.

"Blue–Share", *Acer NeWeb Corporation*, Product Brief, (Prior to May 26, 2000),1 pg.

"Bluetooth—Solutions for Personal Area Networking", *TDK Systems, Inc.*, Manufactures Brochure,(Prior to May 26, 2000),4 pgs.

"Bluetooth Development using SDL, MSC and TTCN", *Teleogic AB*, Product Information,(Prior to May 26, 2000), 13 pgs.

"Bluetooth Product Design—A Natural Progression of Our Existing Business", *RTX*, Manufactures Brochure,(Prior to May 26, 2000),4 pgs.

"Bluetooth White Paper", *AU–System AB*, (1999),Entire Pamphlet.

"Connect 24 Data Communications", *Connect 24*, http://www.connect24.com,(2001),1 page.

"CreataLink", *Motorola,Inc.*, (1999),2 pages.

"CreataLink 2XT", *Motorola Messaging Products*, www.mot.com/MIMS/MSPG/Products/OEM/calxt/(Mar. 1999),1 p.

"CreataLink 2XT", *Motorola*, http://www.motorola.com/MIMS/MSPG/Products/OEM/calxt,(Mar. 1999),1 page.

"Designing Solutions for the Internet Economy", *Intel Developer Forum Spring* 2000, Program Brochure,(Feb. 15–17, 2000),2 pages.

"Digianswer Bluetooth—Development and Demonstration Tools", DIGIANSWER A/S, Product Sheet,(Prior to May 26, 2000),6 pgs.

"DIGIANSWER/Bluetooth Technology", *Digainswer (Irl) Ltd.*, Product Information,(Prior to May 26, 2000),8 pgs.

"Emergency 911 Cellular Phone and Cellular Phone Accessories", *AAA Communications*, http://web.indirect.com/aaa/, (2001),1–7 pages.
"Emergency Terms", *Glossary*, http://www.comcare.org/glossary.htm,(2000),3 pages.
"Empowering the mobile enterprise", *Puma Technology, Inc.*, Manufactures Brochure,(1996–1999),2 pages.
"Emulation System Speeds Development of CDMA Satcom Handsets", *Penton Publishing, inc.*, Product Information, (1997),4 pages.
"Enabling Innovation", *Arm Ltd.*, Product Brochure,(1999), 10 pages.
"Freehand Remote Control Lock", *Remote Control Lock Instruction Manual*, KDL, Inc.,(1997),pp. 1–15.
"Get a better vantage point and outmaneuver the competition", *Cadence Design Systems, Inc.*, Manufactures Brochure,(1999),6 pgs.
"Introduction to the HomeRF Technical Specification", *HomeRF*, (2000),pp. 1–17.
"IVT—Bluetooth Protocol Stack SDL/C Source Code", *Bluthtooth*, Product Brochure,(Prior to May 26, 2000),2 pgs.
"Lucent Technologies and Bluetooth", *Lucent Technologies, Inc.*, Manufactures Brochure,(Dec. 1999),2 pages.
"ObjectGEODE—The Most Advanced Integrated Enviornment for the Development of Distributed Real–time Systems", *VERILOG S.A.*, (1998),Entire Brochure.
"ORA Electronics Introduces Rescue Mate, a Complete Cellular Telephone Safety Package", *Business Wire*, http://www.findarticles.com,(1998),2.
"OSE—the new generation realtime operating system", *ENA OSE Systems*, Informational Brochure,(1999),Entire booklet.
"PSAP Updates and Third–Party Cell Centers", *ComCARE Alliance*, http://www.comcare.org/psap.htm,(2000),2 pages.
"Samsung Electronics joins home radio frequency group in development of wireless network for the home", *Samsung Electronics*, http://www.samsung.com/news/samsung/1998/sea0305.html,(1998),2 pgs.
"Socket's Bluetooth Cordless Communications Card FAQ", *Socket Communications, Inc.*, Informational Literature, (Dec. 1999),2 pages.
"Spontaneous Connections", *CommVerge*, (May 2000),6 pages.
"Tachless Remote Engine Starters", *Almex*. http://www.almexltd.com/iei/mantis 1200.htm,(2000),pp. 1–3.
"Technology Solutions for Bluetooth from Ericsson Microelectronics", *Errricson Components AB*, Manufactures Brochure,(Nov. 1999),1 pages.
"The Ericsson Bluetooth Development Kit—Faster Launching of Bluetooth Products", *Ericsson Mobile Communications, AB*, Manufactures Brochure,(1999),2 pgs.
"The Secret of Success!", *SIGnal Newsletter—The Official Newsletter of the Bluetooth Special Interest Group*, Issue No. 3,(Nov. 1999),8 pgs.
"UMTS W–DCMA Technology Development Using the Aptix System Explorer MP4 for Algorithm Verification", *Aptix Corporation*, Product Information,(1999),4 pages.
"Unleash the World—Core technology for Bluetooth applications", *Ericsson Mobile Communications AB*, Manufactures Brochure,(1999),7 pgs.
"Will the push—not pull—of Internet information dramatically alter our Web Interaction", *SunWorld*, http://www.sunworld.com,(2000),6 pgs.
"Wireless Connections Made Easy", *Bluetooth*, Manufactures Brochure,(Prior to May 26, 2000),19 pgs.
"Your Vision—Our Solution", *RTX Telcom*, Manufactures Brochure,(Prior to May 26, 2000),5 pgs.
Houston, Jerry , "Socket Teams with Cambridge Silicon Radio for Bluetooth Cordless Networking on Windows CE", *Socket Communications, Inc.*, Press Release,(1999),2 pages.
Menard, Raymond J., et al., "Assisted Personal Communication System and Method", *application Ser. No. 10/719, 672, Filed Nov. 21, 2003 Attorney Docket No. 1383,021US2*, 25 pgs.
Menard, Raymond J., et al., "Bi–Directional Wireless Detection System", *application Ser. No. 09/372, 249, Filed Aug. 11, 1999 Attorney Docket No. 00945.018US1 reassigned to 1383,020US1.*, 36 pgs.
Menard, Raymond J., et al., "Bi–directional Wireless Detection System", *application Ser. No. 09/956,474, Filed Sep. 19, 2001 Attorney Docket No. 00945,020US1 reassigned to 1383.020US2*, 38 pgs.
Menard, Raymond J., "Emergency Communication and Monitoring System and Method", *application Ser. No. 10/165,221, Filed Jun. 7, 2002 Attorney Docket No. 1383.937US1*, 29 pgs.
Menard, Raymond J., "Emergency Response Information Distribution", *application Ser. No. 10/409,661, Filed Apr. 7, 2003 Attorney Docket No. 1383.029US2*, 35 pgs.
Menard, Raymond J., et al., "Interactive Motion Sensitive Sensor", *applications Ser. No. 10/601,330, Filed Jun. 20, 2003 Attorney Docket No. 1383,040US3*, 46 pgs.
Menard, Raymond J., et al., "Long Range, Bidirectional, Wireless Personal Communication System", *application Ser. No. 09/277805, Filed Mar. 27, 1999 Attorney Docket No. 945.010US1 reassigned to 1383.010US1*, 25 pgs.
Menard, Raymond J., et al., "Method and System for Wireless Tracking", *application Ser. No. 10/112,669, Filed Mar. 28, 2002 Attorney Docket No. 1383.041US1*, 79.
Menard, Raymond J., et al., "Modular Communications System and Method", *application Ser. No. 09/579,913, Filed May 26, 2000 Attorney Docket No. 945.026US1 reassigned to 1383.026US1*, 68 pgs.
Menard, Raymond J., et al., "Remote Notification of Monitored Condition", *application Ser. No. 10/112,690, Filed Mar. 28, 2002 Attorney Docket No. 1383.044US1*, 75 pgs.
Menard, Raymond J., et al., "Systems and Methods for Transmitting Signals to a Central Station", *application Ser. No. 10/640,876, Filed Aug. 13, 2003 Attorney Docket No. 1383.005US2*, 18 pgs.
Nobel, Carmen , "Microsoft jumps on the Bluetooth bandwagon", *PC Week*, (Dec. 6, 1999),1 page.
Posti, J. , "Motorola Introduces CreataLink 2 XT ReFLEX Two–way Data Transceiver for Wireless Communications", *Motorola Press Release*, www.motcom/MIMS/MSPG/Press/PRI9990303_21575.html,(Mar. 1999),2 p.
Puckek, Daniel R., et al., "Monitoring and Communication System for Stationary and Mobile Persons", *application Ser. No. 10/254,048,Filed Sep. 23, 2002 Attorney Docket No. 1383.048US2*, 41 pgs.
Puckek, Daniel R., et al., "Monitoring and Communication System for Stationary and Mobile Persons", *application Ser. No. 09/315,739, Filed May 20, 1999 Attorney Docket No. 1383.048US1*, 38 pgs.
Webb, Nicholas , "Medical Communication System for Ambulatory Home–Care Patients", *application Ser. No. 08/880,817, Filed Jun. 24, 1997 Attorney Docket No. 1383.046US1*, 30 pgs.

* cited by examiner

| NUMBER OF BITS | OPTION COUNT | DESCRIPTION |
|---|---|---|
| 3 | 8 | DESTINATION CODE, FOR EXAMPLE A LIST OF OPTIONAL CENTRAL STATION AND USER DESTINATIONS IS STORED IN THE WIRELESS NETWORK. THE DESTINATION CODE TELLS THE NETWORK WHICH OPTIONAL DESTINATION SET (8 TOTAL LOOKUP SETS) TO USE FOR THIS MESSAGE. A SET MAY INCLUDE ONE OR MORE POTENTIAL DESTINATIONS. |
| 0–2 | 0–4 | BACKUP DESTINATION CODE: DESIGNATED A BACKUP DESTINATION OPTION IF THE MESSAGE IS UNDELIVERABLE TO THE PRIMARY DESTINATION. THE NETWORK STORES THE BACKUP DESTINATION. THIS INFORMATION COULD BE OPTIONALLY STORED IN THE NETWORK DESTINATION CODE LOOKUP SET DESCRIPTION. |
| 4 | 16 | TYPE OF MESSAGE CODE: THIS DESIGNATES THE TYPE, MEANING OR CONDITION OF THE MESSAGE BEING SENT. FOR EXAMPLE, FIRE, BURGLARY, MEDICAL WOULD ALL BE DESIGNATED ALARM TYPES OR CONDITIONS. THE NETWORK WOULD USE THE DESIGNATED LOOK UP TABLE FOR THE TRANSMITTER INVOLVED IN ORDER TO TRANSLATE THE MESSAGE (IF NECESSARY) BEFORE DELIVERY. OTHERWISE, THE MEANING CAN BE TRANSLATED UPON RECEIPT WITH A DESIGNATED LOOK UP TABLE THERE. |
| 2–4 | 4–16 | MODIFIER CODE: THIS DESIGNATED FURTHER INFORMATION ABOUT THE MESSAGE CODE. FOR EXAMPLE, STATUS INFORMATION, LOCATION (BY ZONE OF DETECTION OR AREA) INFORMATION OR OTHER INFORMATION. |

FIG. 4

DETECTION SYSTEM USING PERSONAL COMMUNICATION DEVICE WITH RESPONSE

CLAIM OF PRIORITY

This application is a continuation of Ser. No. 09/219,737 filed Dec. 22, 1998, which claims the benefit under 35 U.S.C. 119(e) of U.S. provisional patent application Ser. No. 60/098,270, filed Aug. 28, 1998, which is incorporated by reference in its entirety.

FIELD OF THE INVENTION

The present invention relates generally to detection systems and in particular to the use of a personal communication device with response in central station monitoring of security systems.

BACKGROUND

In the security alarm industry, detection devices at a premise detect various conditions at the premise. These conditions may indicate fire, burglary, medical, environmental or other conditions that may exist. The security system then transmits the information to a central response center (central station) that then coordinates the response activities of others back to the premise. However, most of the alarms transmitted are false, which results in the false dispatching of police, fire, and medical teams on a large scale. This creates numerous problems for public response agencies, endangers public safety, and increases costs to consumers and industry providers.

Various industry studies have determined that the source of these false dispatches are caused by the user of the system more than 75% of the time—user error. Much of the user error occurs when the user is actively operating their system; that is, is turning the system on or off. When turning the system on such users are generally exiting the premise and are activating the system to protect the premise in their absence. Likewise, if the user is turning the system off this generally occurs when the user is returning to the premise. As a result, much of the user errors occur when users are coming or going from their premise.

In order to mitigate the number of false dispatches, the industry standard process has been to verify the alarm by attempting to contact the alarm users by telephone at the premise before dispatching a response agency. In such an instance, if the users are arriving at the premise, there is a chance of reaching them. However, most of the time, the users are unavailable because (a) they have just exited the premise—(which accounts for about 50% of the occurrences) or (b) the telephone line to the premise is busy—(some additional percent of the occurrences). When the user is unavailable, then the emergency agency, usually a police department, is dispatched to the premise.

False alarms are such a wide scale problem that many police departments are considering a no-response policy to electronic security systems, and indeed, some police departments in major cities have already implemented such a policy. Other departments are charging for response and many cities have instituted fines for multiple false alarms. If this trend continues, security alarm systems will become more expensive (through the use of private guard response or large fines) which will reduce the number of buyers who can afford or are willing to pay the costs that might be associated with these security systems. This will significantly impact the industry in a negative way and would be unfortunate to the public because security systems do reduce risk of loss and add safety to the persons they protect; not to mention that many thieves have been captured because of these systems.

What is needed in the art is a system to reduce the number of false dispatches so that police departments do not continue to take action against the industry and the owners of security systems. The system should be easy to use and should provide a user with the ability to cancel false alarms quickly.

SUMMARY

The present system provides notification to users of a security system of a detected alarm condition. In one embodiment, this notification is performed simultaneously or nearly simultaneously with the central station. In one embodiment, the notification is performed using a wide scale wireless system so that the users can be notified regardless of their current location.

Such a system solves many of the previously stated problems and several others not mentioned herein. In one embodiment, the user is signaled using a wireless system, so if the user is leaving the premise, and perhaps at a significant distance, the user will still be notified. In one embodiment, the system connects the users of the security system directly to the central station system so that the alarm can be immediately verified or canceled with the central station. In the embodiment where the connection is wireless, the user or users may be in any location within the range of the wireless network. If the central station receives a cancellation of the alarm they can avoid dispatching the emergency agency or perhaps recall them if the dispatch has occurred.

In one embodiment the system provides a dynamic response process that is adjusted in real time or nearly instantaneously by the users of the system. That is to say, more than half of all false alarms may be canceled and more than half of all false dispatches can probably be avoided.

In one embodiment, the system provides nearly simultaneous and wireless connection of electromechanical data from a security or other detection system, remote human intervention (usually the users of the detection system), and the response centers to provide direction to a response effort. One aspect of this design is that the users of the detection system participate in directing the response effort indicated by various alarms from a security or other detection system.

Due to cost, power requirements, and relative design sizes, one embodiment of the system incorporates Narrowband PCS systems, otherwise known as 2-Way paging. Other embodiments include, but are not limited to, PCS, cellular, cellemetry and other broad scale wireless networks. Other embodiments incorporate combinations of these networks.

This summary is intended to provide a brief overview of some of the embodiments of the present system and is not intended in an exclusive or exhaustive sense, and the scope of the invention is to be determined by the attached claims and their equivalents.

BRIEF DESCRIPTION OF THE DRAWINGS

FIG. 4: A table that depicts an encoding process according to one embodiment of the present system.

DETAILED DESCRIPTION

Figure 1:
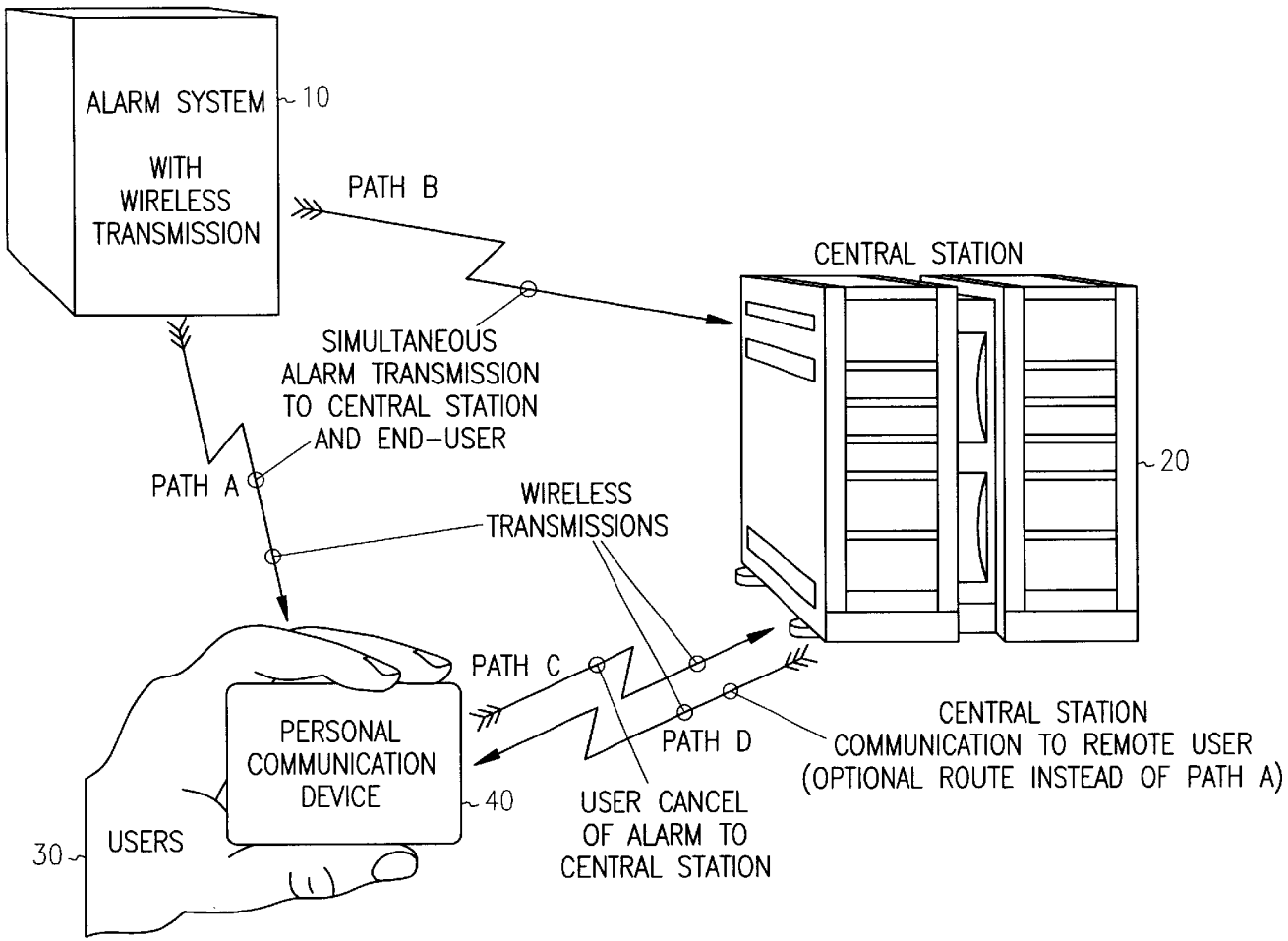
FIG. 1: Depicts the communication paths between the security system, the system user(s), and the central station according to one embodiment of the present system.

This detailed description provides a number of different embodiments of the present system. The embodiments provided herein are not intended in an exclusive or limited sense, and variations may exist in organization, dimension, hardware, software, mechanical design and configuration without departing from the claimed invention, the scope of which is provided by the attached claims and equivalents thereof.

The present detection system provides many benefits, including, but not limited to, reduction of false alarms and false dispatches. The present detection system provides a user with the ability to cancel false alarms quickly and is straightforward to use. Many other benefits will be appreciated by those skilled in the art upon reading and understanding the present description. Furthermore, U.S. provisional patent application Ser. No. 60/098,270 filed Aug. 28, 1998 is incorporated by reference in its entirety.

The present system provides notification to users of a security system of a detected alarm condition. In one embodiment, this notification is performed simultaneously or nearly simultaneously with the central station. In one embodiment, the notification is performed using a wide scale wireless system so that the users can be notified regardless of their current location.

In one embodiment, the user is signaled using a wireless system, so if the user is leaving the premise, and perhaps at a significant distance, the user will still be notified. In one embodiment, the system connects the users of the security system directly to the central station system so that the alarm can be immediately verified or canceled with the central station. In the embodiment where the connection is wireless, the user or users may be in any location within the range of the wireless network. If the central station receives a cancellation of the alarm they can avoid dispatching the emergency agency or perhaps recall them if the dispatch has occurred.

In one embodiment the system provides a dynamic response process that is adjusted in real time or nearly instantaneously by the users of the system. That is to say, more than half of all false alarms may be canceled and more than half of all false dispatches can probably be avoided.

In one embodiment, the system provides nearly simultaneous and wireless connection of electromechanical data from a security or other detection system, remote human intervention (usually the users of the detection system), and the response centers to provide direction to a response effort. One aspect of this design is that the users of the detection system participate in directing the response effort indicated by various alarms from a security or other detection system.

Due to cost, power requirements, and relative design sizes, one embodiment of the system incorporates Narrowband PCS systems, otherwise known as 2-Way paging. Other embodiments include, but are not limited to, PCS, cellular, cellemetry and other broad scale wireless networks. Other embodiments incorporate combinations of these networks.

Capcodes

In one embodiment using NPCS (Narrowband PCS) as the wireless transmission method, pager capcodes identify the individual user and the detection system that is transmitting the message. Capcodes are the addresses used to identify individual addresses—there is a unique capcode for each pager or common pager address, and common addressing—pagers can hold more than one capcode for broadcast messaging. For example, capcode 978654903 may uniquely indicate Joe Smith's pager while another capcode may also reside on Joe Smith's pager for broadcast receipt of the news or weather. In one embodiment one or more capcodes may be used to uniquely identify one or more central stations.

Communication Paths

FIG. 1 shows one embodiment of the present detection system in which an alarm system 10 provides a signal to a central station 20. In this embodiment, the users 30 are notified of the alarm condition via a wireless means in order to provide the highest assurance of contact. Otherwise by using a standard land line telephone, it may not be possible to find the user. This wireless system is depicted as Path A in FIG. 1. In this embodiment, the central station 20 receives its verification information back from the user 30 having personal communication device 40 via wireless so that notification comes rapidly from wherever the user is located, otherwise the dispatch process will continue without an opportunity for intervention from the users 30. This is depicted as Path C in FIG. 1.

If Path A is selected instead of Path D, then in one embodiment a method of transmitting Path B is by a wireless technology matching Path A. This allows for the messaging to arrive at similar times at both the remote users 30 and the central station 20. As a result, the dispatch process has a good chance of starting in a synchronized fashion for both the central station 20 and the users 30. This will lead to a better coordinated effort.

In one embodiment, the personal communication device 40 is a two-way pager. In one embodiment, the personal communication device 40 is a cellular phone. Other personal communication devices 40 may be used without departing from the present system.

Rapid Data Transmission

It is important that the data is received rapidly both to enhance protection and to help to provide rapid verification in order to cancel alarms. The transmission of data in this embodiment is done in a rapid burst method. One reason for this is as follows: As available in NPCS transmissions, for example with FLEX 25, REFLEX 25, or REFLEX 50 (communications protocols by MOTOROLA CORPORATION)—one of the protocols currently available for NPCS services—there is a short message availability (11 bit) that allows for very rapid transmission. In cellular there is a technology called cellemetry that accomplishes a similar function. This short and rapid messaging is a feature of many large scale wireless networks. The short message is typically available to be sent immediately and rapidly. For example, in FLEX 25, longer messages require time to set up transmission frames. By using a short form transmission, as much as 20 seconds or more may be saved in the transmission time requirement. This delay is of serious consequence because in at least one application—the security industry—life and property may be in peril. In addition, delays make it difficult to coordinate the rapidly proceeding dispatch between the central station 20 and the users 30. However, the short message has constraints of its own: it is a short message. Therefore, in one embodiment using FLEX 25, the message is encoded. One solution for encoding is presented later.

Hence, in this embodiment a short predetermined digitally encoded message is transmitted from the alarm system 10 to the central station 20 and to the personal communication device 40 carried by remote users 30. In one embodiment, at the central station 20 a look up table is employed to decode the message. Additionally, in one embodiment, a look up table is employed by the remote user device 40 to decode the message.

Message Decoding in the Network

Usually transmission networks are designed to receive a message and transport it to a destination. The network doesn't "read" the message or "act" on it except to read an address and send it to the destination. However, as networks become imbued with enhanced computing capability, they can read more of the message and process far beyond mere transport.

Therefore, as an alternative embodiment, the look up table can reside in the network and the message can be decoded by the network before it is delivered to any destination. This is a good way for delivering a message to the users 30. The encoded short form message is decoded in the network and a user 30 is delivered an English (or other language) language message according to the interpretation or look up table.

The effect is that an encoded short form message that looks like "001010000111" can be decoded in the network and read out, for example, "Burglary Area 4" on a device 40, such as a pager. The same numeric message can be decoded after receipt in a more sophisticated user device 40 or after receipt at the central station 20.

Communication with the User

One embodiment of this design uses a single two way wireless device 40 carried by the users 30 instead of one device to receive the message and another to transmit the verification information to the central station 20. This saves cost and simplifies design. However, two separate devices 40 could be used.

The notification of the remote users 30 can be accomplished simultaneously with the central station 20 or instantly relayed by the central station 20 or any other relay point. Either process has an identical effect of creating nearly simultaneous notification of an alarm condition to the users 30 and the central station 20.

Information relative to verification, dispatch cancellation or other instructions, sent from the users to the central station 20 can be received as data that is automatically integrated into the automation system at the central station 20.

However, in other embodiments, manual processing of the data or other messages can be done.

Because the user information comes from a different device (different capcode when using NPCS) than the security alarm report from the users' security system, the information must be integrated in the central station automation system as related information from discrete sources. Existing methods used for integrating multiple security systems reporting from a single premise can be used to integrate these multiple sources of information. These methods vary between various automation systems, but the effective result is the same and can be used to a new benefit.

Again, in one embodiment, the transmission of data can be done in a rapid burst method. In this process, a short predetermined digitally encoded message is transmitted to the central station 20 from the user device 40.

Alternatively, longer messages can be employed, but they may take longer to be received.

At the central station 20 a look up table is employed to decode the message. As before, alternatively, the look up table can reside in the network and the message can be decoded by the network before it is delivered to any destination. The central station 20 can receive instructions not to dispatch an emergency agency or other instructions regarding a pending or processing dispatch.

In the event that NPCS is the selected wireless transmission method, a standard two way pager using "response paging" can be used as the response device 40 carried by the user 30 to provide direction to the central station 20, in one embodiment.

In this design option a response message can either be presaved on the two way pager or can be transmitted to the pager. Since time is important, a presaved response message is a fast solution since it does not require any additional transmission time.

Other embodiments incorporating custom designed devices and devices using other wireless technologies can also be used to accomplish the same effect.

Encoding

In one embodiment, encoding is a straightforward process. The following encoding example is offered for the use with NPCS FLEX 25 or REFLEX 25 two way pager wireless services.

In Flex 25 an 11 bit message (an 11 bit message is eleven zeros or ones) is available for a short form transmission. This message is then split into registry sections for the purpose of sending a message. The table in FIG. 4 describes sample registers and their potential purpose.

As a result a message like "001/0111/0101" (slashes indicate breaks in the register of the look up table and are not transmitted) can be interpreted to mean: send a message to Joe Smith's pager capcode 957843756 reading "Fire area 5" and send a message "001/0111/0101" to Central Station A and send "001/0111/0101" to Central Station B if Central Station A is not receiving.

The above register size, order, and meaning can be changed to meet the needs of individual network designs. However, the purpose and use remains unchanged. Similar encoding registers can be used in any wireless transmission short form format.

EXAMPLES

Figure 2:
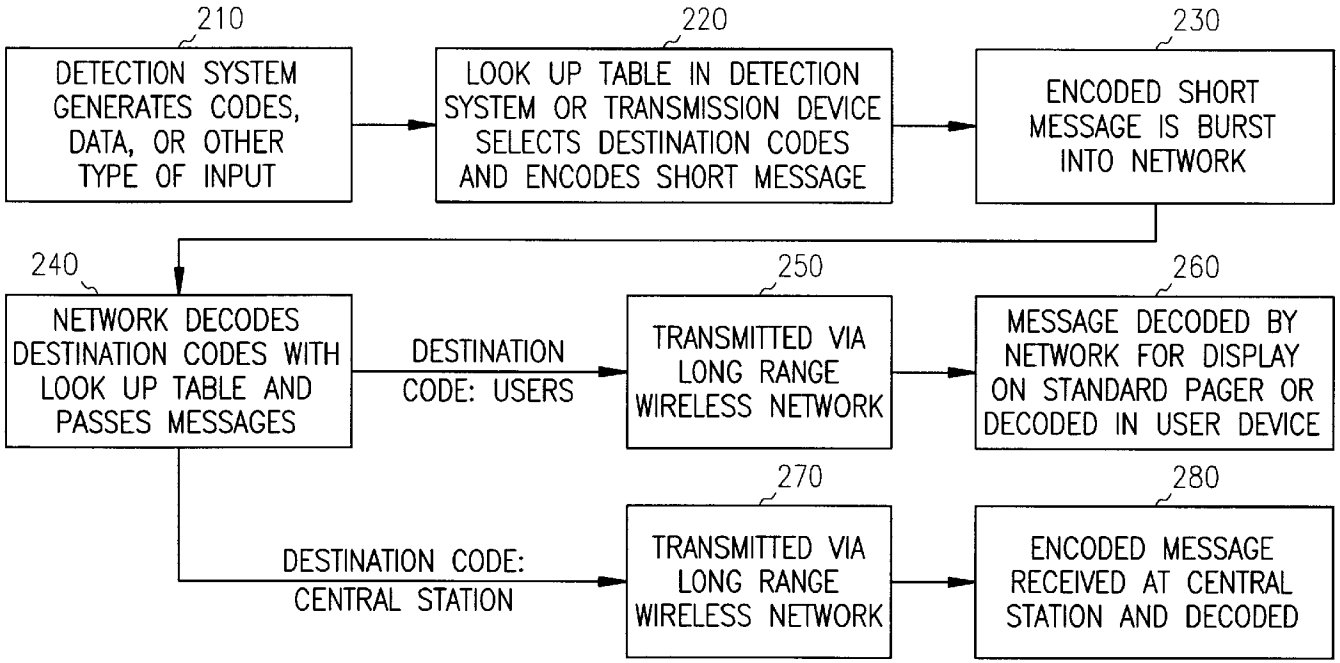
FIG. 2: Depicts the encoding and decoding of burst messages on a NPCS network, according to one embodiment of the present system.

One embodiment of the present system is provided in FIG. 2. The detection system generates codes, data, or other type of input 210. In one embodiment, a look up table in the detection system or transmission device selects destination codes and encodes short messages 220. The encoded short message is burst into the network 230. The network decodes destination codes with look up table and passes messages 240. If the destination code is a user code, then the message is transmitted via a long range wireless network 250. The message is decoded by the network for display on a pager or decoded in the user device 260. If the destination code indicates a central station, then the message is transmitted via long range wireless network 270 and the encoded message is received and decoded at the central station 280.

Figure 3:
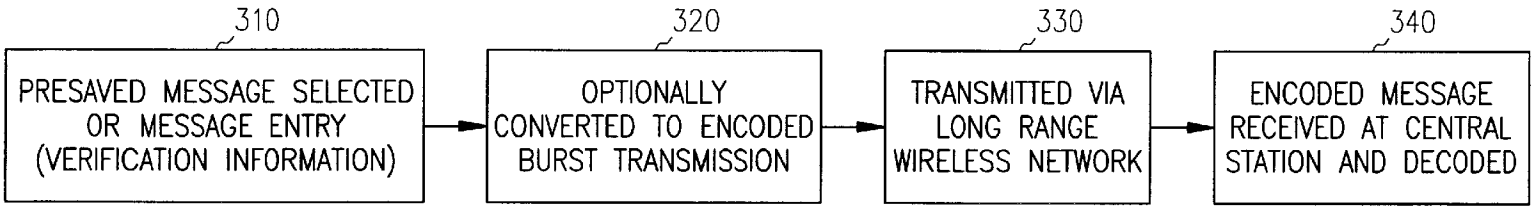
FIG. 3: Depicts the transmission of the verification information from the user to the central station according to one embodiment of the present system.

In FIG. 3, transmissions from a remote user to a central station are shown. In one embodiment, a presaved message is selected or entered using verification information 310 and optionally it is converted to an encoded burst transmission 320. The information is transmitted via a long range wireless network 330 and decoded at the central station destination 340.

We claim:

1. A system conducting communications over a long distance bidirectional communication network for providing dispatch information to a central station, comprising:

a detection system adapted for automatic communication of alarm information related to a detected event; and a portable wireless two way communication device adapted for receiving the alarm information from the long distance bidirectional communication network and for providing notification of an alarm condition, wherein the portable wireless two way communication device is operable to provide a signal to cancel the alarm condition to avoid unnecessary dispatch by the central station wherein the signal to cancel the alarm condition includes transmission of a pre-saved message from the portable wireless two way communication device to the central station.

2. The system of claim 1, wherein the detection system simultaneously communicates alarm information to the central station and the portable wireless two way communication device.

3. The system of claim 1, wherein the detection system communicates alarm information to the central station and the central station then relays the information to the portable wireless two way communication device.

4. The system of claim 3, wherein the alarm information includes a destination code, and wherein the long distance bidirectional communication network uses a look-up table to decode the destination code.

5. The system of claim 1, wherein the portable wireless two way communication device is a two way pager.

6. The system of claim 5, wherein the two way pager communicates via Narrowband PCS (NPCS) transmissions.

7. The system of claim 6, wherein the NPCS transmissions are made using a FLEX 25 communication protocol.

8. The system of claim 6, wherein the NPCS transmissions are made using a REFLEX 25 communication protocol.

9. The system of claim 6, wherein the NPCS transmissions are made using a REFLEX 50 communication protocol.

10. The system of claim 1, wherein the portable wireless two way communication device is a cell phone.

11. The system of claim 1, wherein the portable wireless two way communication device is a back-up portable wireless two-way communication device when a primary portable wireless two way communication device is unavailable.

12. The system of claim 1, wherein the signal to cancel the alarm condition includes transmission from the portable wireless two way communication device to the central station.

13. The system of claim 1, wherein the signal to cancel the alarm condition includes transmission from the portable wireless two way communication device to the detection system.

14. The system of claim 1, wherein the signal to cancel the alarm condition includes transmission of a pre-saved message converted to a burst transmission from the portable wireless two way communication device to the central station.

15. The system of claim 1, wherein the detection system transmits an encoded message related to the alarm condition.

16. The system of claim 15, wherein the central station includes a look-up table to decode the encoded message related to the alarm condition.

17. The system of claim 15, wherein the portable wireless two way communication device includes a look-up table to decode the encoded message related to the alarm condition.

18. The system of claim 17, wherein the portable wireless two way communication device displays the decoded message related to the alarm condition.

19. The system of claim 1, wherein canceling the alarm condition to avoid unnecessary dispatch by the central station includes recalling an emergency agency if the dispatch has already occurred.

* * * * *

UNITED STATES PATENT AND TRADEMARK OFFICE

CERTIFICATE OF CORRECTION

PATENT NO. : 6,847,293 B2
DATED : January 25, 2005
INVENTOR(S) : Menard et al.

It is certified that error appears in the above-identified patent and that said Letters Patent is hereby corrected as shown below:

Title page,
Item [56], References Cited, U.S. PATENT DOCUMENTS, “3,843,841” reference, delete "Rubenstein" and insert -- Rubinstein --, therefor; and “5,276,728” reference, delete "Pagllaroli" and insert -- Pagliaroli --, therefor.
OTHER PUBLICATIONS, “AlarmNet–A Original Alarmnet” reference, after "http" delete ";" and insert -- : --, therefor.

Column 7,
Line 8, after "station" insert -- , --.

Signed and Sealed this

Twenty-sixth Day of July, 2005

JON W. DUDAS
*Director of the United States Patent and Trademark Office*